US005758713A

United States Patent [19]

Fallet

[11] Patent Number: 5,758,713

[45] Date of Patent: Jun. 2, 1998

[54] DEVICE FOR DECORING CORES OF CASTINGS

[75] Inventor: Daniel Fallet, La Neuville en Hez, France

[73] Assignee: Dimafond - Distribution et Ingenierie de Materiel pour la Fonderie, Saint-Soupplets, France

[21] Appl. No.: 583,719

[22] Filed: Jan. 5, 1996

[51] Int. Cl.[6] ..... B22D 29/00; B22D 29/02

[52] U.S. Cl. ..... 164/404; 164/345

[58] Field of Search ..... 164/345, 404

[56] References Cited

U.S. PATENT DOCUMENTS

| | | | |
|---|---|---|---|
| 4,643,243 | 2/1987 | McKibben et al. | 164/404 |
| 5,213,150 | 5/1993 | Sensenstein | 164/345 |
| 5,460,219 | 10/1995 | Massin et al. | 164/132 |

FOREIGN PATENT DOCUMENTS

| | | | |
|---|---|---|---|
| 0 144 031 | 6/1985 | European Pat. Off. . | |
| 0200860 | 11/1986 | European Pat. Off. | 164/345 |
| 3 239 262 | 4/1984 | Germany . | |
| 8502137 | 5/1985 | WIPO | 164/345 |

*Primary Examiner*—Joseph J. Hail, III
*Assistant Examiner*—I.-H. Lin
*Attorney, Agent, or Firm*—Young & Thompson

[57] ABSTRACT

The device comprises a rigid frame (12) having a vertical axis of symmetry (X) forming a virtual axis of oscillation of the frame defined by the intersection of the longitudinal and transverse vertical median planes of the frame. This frame is connected to a fixed support (14) by elastically deformable connecting elements (16). The decoring device further comprises two devices (24) for clamping castings to be decored carried by two opposite ends of the frame (12) and aligned in the longitudinal median plane, and two out of balance motors (26) fixed to two opposite sides of the frame (12), these motors having axes of rotation parallel to the axis of symmetry (X) of the frame (12) and being aligned with this axis of symmetry in the transverse median plane. The motors (26) are adapted, in operation, to cause the frame (12) to oscillate about its virtual axis X so that the centre of gravity of each casting to be decored describes a substantially horizontal and ellipsoidal path.

9 Claims, 3 Drawing Sheets

DEVICE FOR DECORING CORES OF CASTINGS

FIELD OF THE INVENTION

The present invention relates to an improved device for decoring cores of castings.

BACKGROUND OF THE INVENTION

It is generally applicable to the decoring of sand cores in hollow castings and more particularly in cylinder heads or manifolds for internal combustion engines.

The hollow parts of a casting are usually cast around sand cores whose shapes are complementary to those of the hollow parts.

The elimination of the cores after a casting is all the more difficult to achieve as this casting has a complicated shape.

It is known to eliminate the cores in a casting of complex shape, such as an engine cylinder head, by subjecting this casting to a hammering so as to detach the sand cores, then to vibrations so as to disintegrate the sand cores and discharge the fragments of the cores by the effect of gravity.

Various types of decoring devices are known in the art which permit vibrating a casting so as to disintegrate the cores.

However, the proposed devices either are complex and fragile or are not fully satisfactory and leave fragments cores adhering to the castings.

An object of the invention is to provide a simple and effective decoring device which permits obtaining a complete elimination of the cores, even in the case of a casting of complex shape such as a cylinder head of an internal combustion engine.

SUMMARY OF THE INVENTION

The invention therefore provides a device for decoring cores of castings, characterized in that it comprises a rigid frame having a vertical axis of symmetry forming a virtual pivot axis of the frame, defined by the intersection of longitudinal and transverse vertical median planes of the frame, said frame being connected to a fixed support by elastically deformable connecting means, the decoring device further comprising two clamping devices for clamping castings to be decored carried by two opposite ends of the frame and being aligned in the longitudinal median plane, and two out of balance motors which are connected to two opposite sides of the frame, have axes of rotation parallel to the axis of symmetry of the frame and aligned with said axis of symmetry in the transverse median plane, the motors being adapted in operation, to cause the frame to pivot about its virtual axis so that the centre of gravity of each casting to be decored describes a substantially horizontal and ellipsoidal path.

According to other features of the invention:

the means connecting the frame to the support comprise four cylindrical joints which have vertical axes, are transversely elastically deformable and are disposed symmetrically in pairs relative to the longitudinal and transverse vertical median planes.

each clamping device comprises a fixed jaw and a movable jaw defining confronting vertical clamping faces between which a casting to be decored is maintained;

the movable jaw is carried by at least one pneumatic chamber jack;

the fixed jaws and the movable jaws respectively of the two clamping devices are mounted in opposed relation relative to the longitudinal vertical median plane;

the median part of the frame on which the motors are fixed is narrower than the end parts of the frame carrying the clamping devices;

the frame is provided with a framework comprising horizontal plates interconnected by vertical longitudinal webs;

each clamping device comprises two vertical end plates which are symmetrical relative to the longitudianl median plane and fixed to opposite edges of a rectangular notch formed in the corresponding ends of the horizontal plates of the framework, a first end plate constituting the fixed jaw of the clamping device, the second end plate forming a support for a fixed end of the pneumatic jack, the clamping device further comprising a third plate which is parallel to the fixed jaw, carried by the movable end of the pneummatic jack, and forms the movable jaw of the clamping device;

the fixed jaws of the clamping devices comprise through openings for means for hammering the castings held in the clamping device.

BRIEF DESCRIPTION OF THE DRAWINGS

An embodiment of the invention will now be described hereinafter with reference to the accompanying drawings, in which.

DETAILED DESCRIPTION OF THE INVENTION

Figure 1:
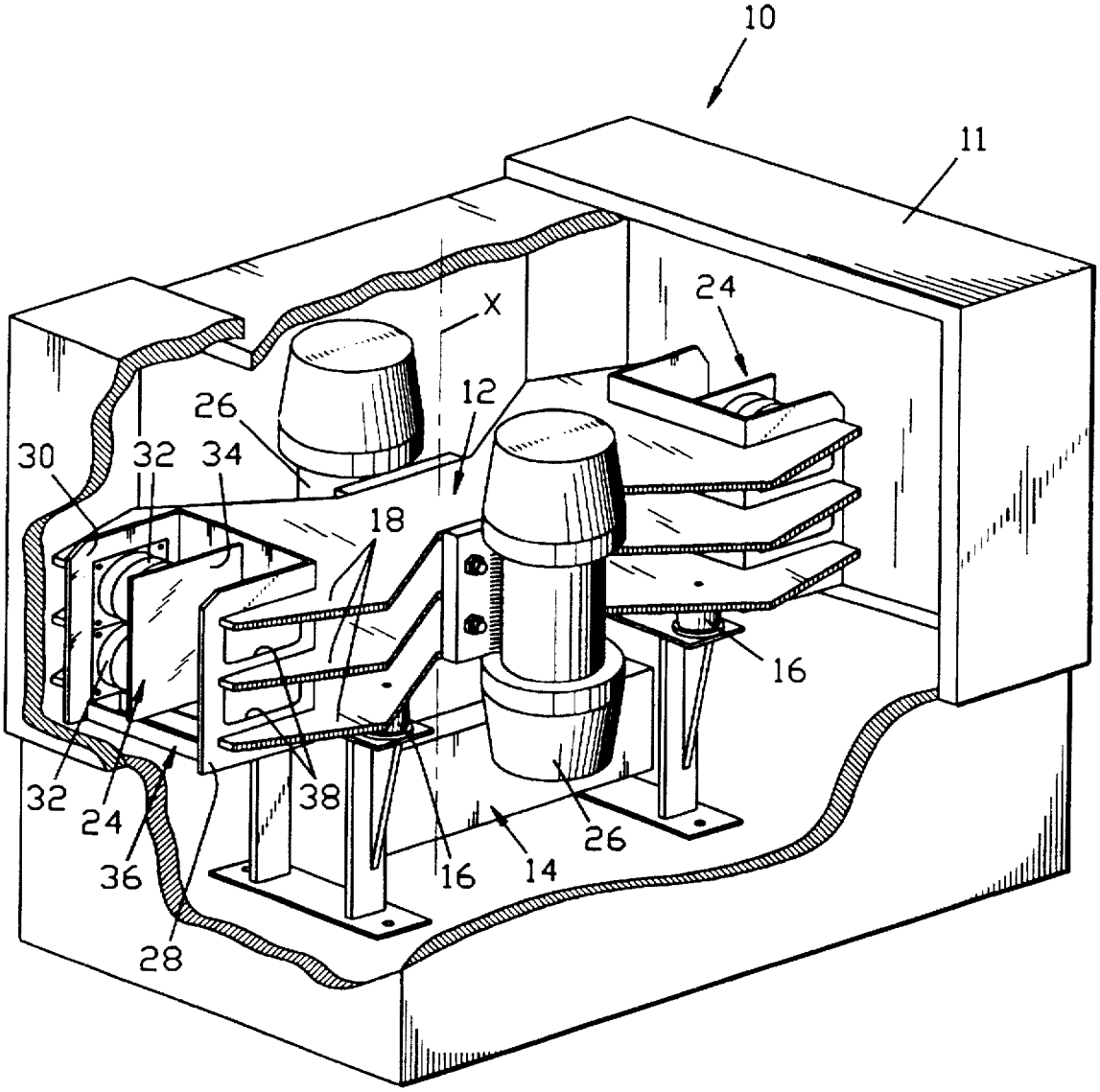
FIG. 1 is a perspective view of a decoring device according to the invention.
Figure 2:
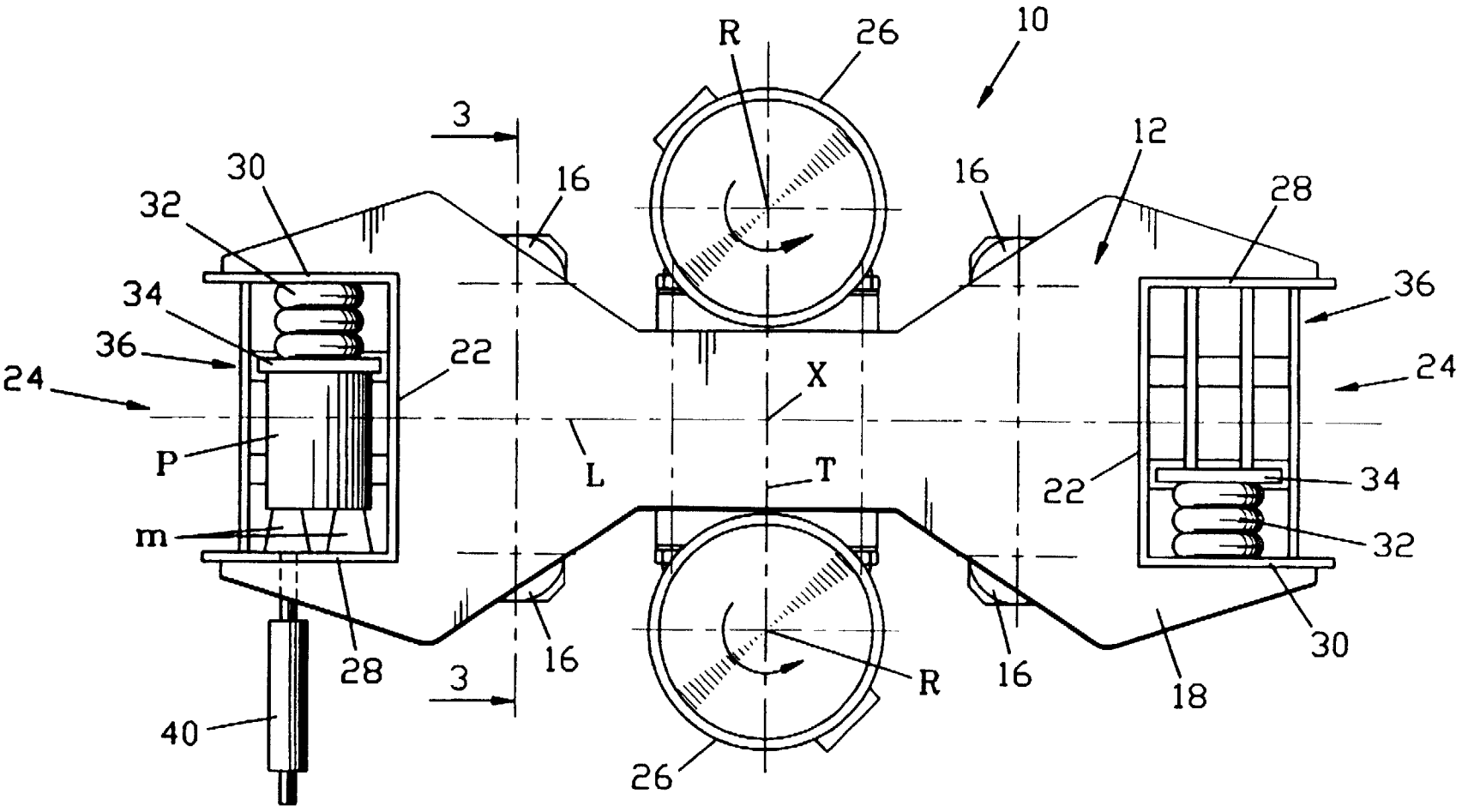
FIG. 2 is a planned view of the decoring device of Fig. 1.
Figure 3:
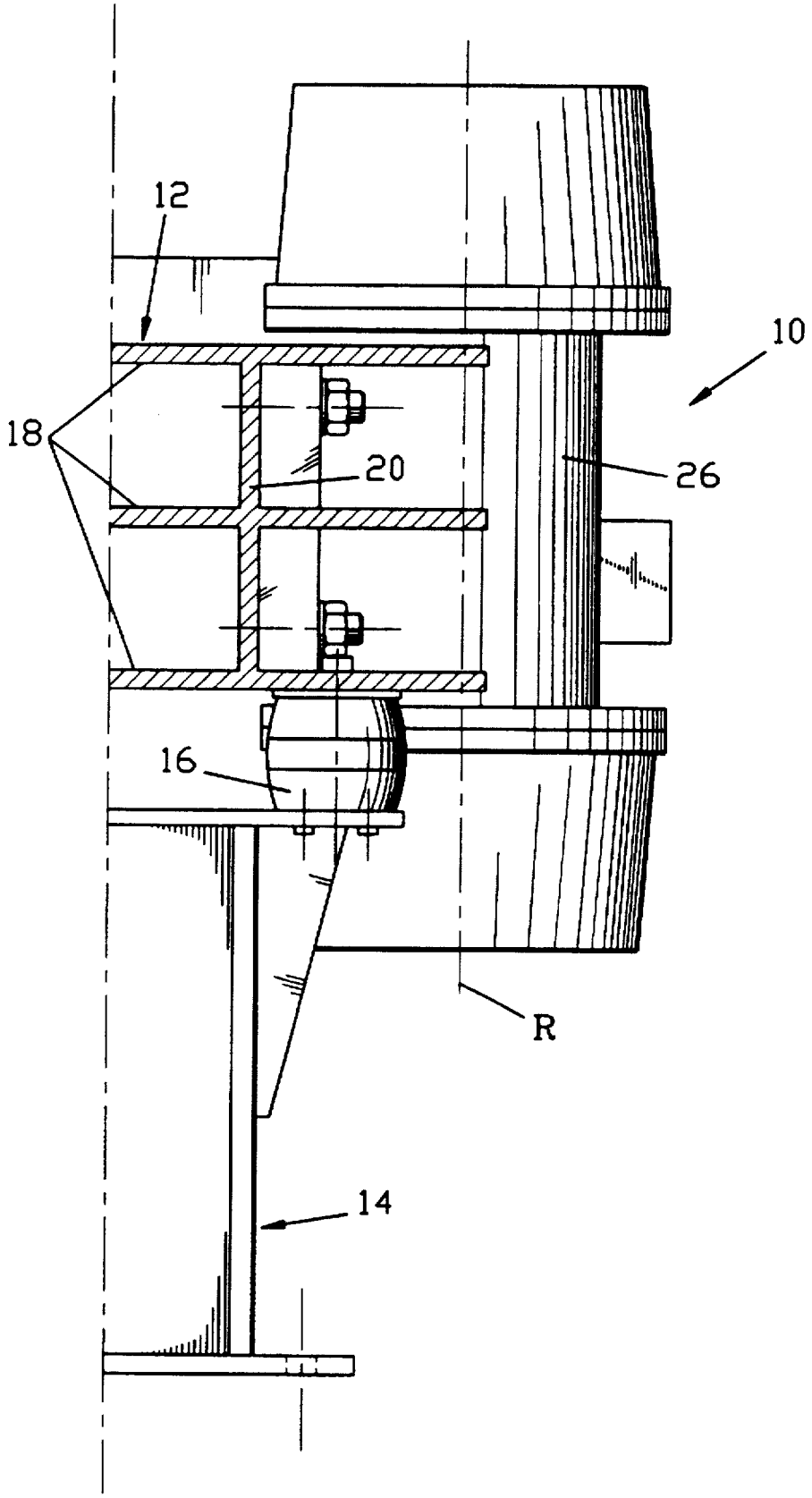
FIG. 3 is a semi-sectional view taken on line 3—3 of FIG. 2 to a larger scale.

Shown in FIGS. 1 to 3 is a device according to the invention designated by the general reference numeral 10, for decoring cores of castings such as cylinder heads for internal combustion engines.

The device 10 is adapted to decore two castings at a time, only one of which is shown in FIG. 2 for reasons of clarity. The casting shown in FIG. 2 is a cylinder head P provided with casting heads m.

Preferably, the decoring device 10 is placed in a noise-muffling case 11 provided with closable access openings as shown in FIG. 1.

The device 10 comprises a rigid frame 12 having a generally elongate shape, with a vertical axis of symmetry X constituting a virtual axis of oscillation of the frame, as will be described in more detail hereinafter, defined by the intersection of a longitudinal vertical median plane L and a transverse vertical median plane T of the frame, these two planes being shown in dot-dash lines in Fig. 2.

The frame 12 is connected to a fixed support 14 by four cylindrical joints 16 which are of known type, have vertical axes, are transversely elastically deformable, and disposed symmetrically in pairs relative to the longitudinal and transverse vertical median planes L and T respectively.

The frame 12 is provided with a framework comprising three superimposed horizontal plates 18 which have generally identical shapes, are interconnected by two longitudinal vertical webs 20 welded to the horizontal plates 18, a single web 20 being shown in FIG. 3.

The width of the horizontal plates 18 is smaller in their median part than in their end parts, the latter having rectangular notches 22 which are open on the side remote from the axis of symmetry X.

The decoring device 10 further comprises two devices 24 for clamping the parts or castings to be decored which are carried by two ends of the frame 12 and are aligned in the longitudianl median plane L, and two out of balance motors 26 of known type fixed in the conventional manner to the two opposite sides of the frame defined by the narrow median parts of the horizintal plates 18. The axes of rotation R of these motors 26 are parallel to the axis of symmetry X of the frame 12 and aligned with this axis of symmetry in the transverse median plane T.

Each clamping device 24 is arranged between two vertical end plates 28, 30 which are symmetrical relative to the longitudinal median plane L and fixed to opposite edges of the notches 22. A first end plate 28 constitutes a fixed clamping jaw and a second end plate 30 forms a support for at least one pneumatic chamber jack 32 of known type, for example that sold under the name "PNEURIDE" by the company PARKER. The pneumatic jack 32 is provided with a fixed end connected to the support 30 and a movable end carrying a plate 34 parallel to the two end plates 28, 30 and forming a movable clamping jaw.

The jaws 28, 34 therefore define confronting vertical clamping faces between which a part or casting P to be decored is maintained.

In order to balance the frame 12 about its axis of symmetry, the fixed jaws 28 and the movable jaws 34 respectively of the two clamping devices 24 are mounted in opposition to each other relative to the longitudinal median plane L.

In the embodiment shown in the Figures, each clamping device 24 comprises two pneumatic chamber jacks 32 carrying the movable jaw 34 and aligned vertically. The number of pneumatic jacks employed in a clamping device depends on the weight of the casting to be decored.

Horizontal grills 36 are disposed between the lower end of the end plates 28, 30 of the clamping devices. These grills 36 constitute supports facilitating the positioning and the withdrawal of the castings to be decored and permit the passage under the effect of gravity of the fragments of the cores which are detached from these castings.

With reference to FIG. 1, it can be seen that the fixed jaw of a clamping device has openings 38 defining passages for known means for hammering the casting P. These hammering means comprise for example a pneumatic hammer 40 such as that shown in FIG. 2 which is adapted to strike a part of the casting to be decored disposed in alignment with the openings 38, this part being constituted for example by the feed heads m in one piece with the casting.

In an alternative embodiment, a plate may be interposed between the heads m and the hammer 40, in particular when these heads are relatively fragile.

The operation of the decoring device shown in the Figures is very simple.

First of all, each of the castings P to be decored is clamped between the jaws 28, 34 of the corresponding clamping devices 24 by supplying compressed air to the pneumatic jacks 32.

Then, with the out of balance motors 26 inoperative, each casting P is hammered by means of the pneumatic hammer 40 in accordance with a known procedure.

After the hammering operation, the out of balance motors 26 are started up so that they rotate in identical directions indicated by the arrows in FIG. 2.

The rotation of the motors 26 has for effect to cause the frame 12 to oscillate about its virtual axis X by elastically deforming the joints 16 substantially in a horizontal plane so that the centre of gravity of each casting P to be decored oscillates by describing a substantially horizontal and ellipsoidal path whose major axis extends transversly relative to the frame 12.

The effect of the oscillations is to completely disintegrate the cores without any fragment remaining in the hollows of the castings.

Preferably, the power of the out of balance motors 26 is so adapted that the amplitude of the oscillations of the castings to be decored, measured along the major axis of the ellipsoidal path are between about 12 and 16 mm.

In the described embodiment, each out of balance motor has a power of about 5 kW, and each pneumatic jack is supplied with compressed air having a pressure of about 2 to 5 bars so as to be capable of decoring castings of various weights.

The amplitude of the oscillations of the centre of gravity of the castings to be decored, measured along the major axis of the ellipsoidal path, is about 14 mm, namely 7 mm on each side of the position of rest of the centre of gravity, for a frequency of 1,500 oscillations/min., i.e. 1,500 alternations/min. about the position of rest of the centre of gravity.

It will be understood that the amplitude and the frequency of the oscillations of the castings to be decored may vary in accordance with the setting of the out of balance motors. Further, the power of these motors is chosen in accordance with the weights of the castings to be decored.

The invention has many advantages.

The device according to the invention permits decoring two castings at a time by subjecting the latter to vibrations transmitted by the frame carrying these castings without using the conventional transmission means employing links and cranks which are complex and fragile.

Consequently, the decoring device according to the invention is very strong and reliable.

The vibrations produced by the decoring device according to the invention have amplitudes and frequencies exceeding those obtained in conventional devices, whereby it is possible to completely disintegrate the cores without leaving any fragment inside the castings.

What is claimed is:

1. Device for decoring cores of castings, comprising in combination: a fixed support, a rigid frame having a vertical axis of symmetry forming a virtual axis of oscillation of the frame defined by intersection of longitudinal and transverse vertical median planes of said frame, elastically deformable connecting means connecting said frame to said fixed support, two clamping devices for clamping castings to be decored carried by two opposite ends of said frame and aligned in said longitudinal median plane, and two out of balance motors which are fixed to two opposite sides of said frame, have axes of rotation parallel to said axis of symmetry of said frame and are aligned with said axis of symmetry in said transverse median plane, and adapted in operation to cause said frame to oscillate about said virtual axis so that the centre of gravity of each casting to be decored describes a substantially horizontal and ellipsoidal path.

2. Device according to claim 1, wherein said means connecting said frame to said support comprise four cylindrical joints which have vertical axes, are transversly elastically deformable and are disposed symmetrically in pairs relative to said longitudinal and transverse vertical median planes.

3. Device according to claim 1, wherein each clamping device comprises a fixed jaw and a movable jaw which define confronting vertical clamping faces between which faces a casting to be decored is maintained.

4. Device according to claim 3, comprising at least one pneumatic chamber jack carrying said movable jaw.

5. Device according to claim 3, wherein said fixed jaws and said movable jaws respectively of said two clamping devices are mounted in opposed relation relative to said longitudinal vertical median plane.

6. Device according to claim 3, wherein said frame is provided with a framework comprising horizontal plates and longitudinal vertical webs interconnecting said horizontal plates, a rectangular notch being provided in corresponding ends of said horizontal plates of said framework, each clamping device comprising two vertical end plates which are symmetrical relative to said longitudinal median plane and are fixed to opposite edges of said rectangular notch, a first of said end plates constituting said fixed jaw of said clamping device and a second of said end plates constituting a support for a fixed end of said pneumatic jack, each clamping device further comprising a third plate parallel to said first end plate and carried by a movable end of said pneumatic jack and forming said movable jaw of said clamping device.

7. Device according to claim 3, wherein said fixed jaws of said clamping devices comprise through openings for means for hammering said castings held in the respective clamping device.

8. Device according to claim 1, wherein said frame has a median part on which said motors are fixed and two end parts which carry said clamping devices, said median part being narrower than said end parts of said frame.

9. Device according to claim 1, wherein said frame is provided with a framework comprising horizontal plates and longitudinal vertical webs interconnecting said horizontal plates.

* * * * *